US009152158B2

(12) United States Patent
Dobkin et al.

(10) Patent No.: US 9,152,158 B2
(45) Date of Patent: Oct. 6, 2015

(54) LINEAR REGULATOR IC WITH VERSATILE GROUND PIN

(71) Applicant: Linear Technology Corporation, Milpitas, CA (US)

(72) Inventors: Robert Dobkin, Monte Sereno, CA (US); Amitkumar Pravin Patel, Milpitas, CA (US)

(73) Assignee: Linear Technology Corporation, Milpitas, CA (US)

( * ) Notice: Subject to any disclaimer, the term of this patent is extended or adjusted under 35 U.S.C. 154(b) by 281 days.

(21) Appl. No.: 13/969,893

(22) Filed: Aug. 19, 2013

(65) Prior Publication Data

US 2014/0312866 A1 Oct. 23, 2014

Related U.S. Application Data

(60) Provisional application No. 61/813,789, filed on Apr. 19, 2013.

(51) Int. Cl.
*G05F 1/575* (2006.01)
*G05F 1/46* (2006.01)

(52) U.S. Cl.
CPC ..... *G05F 1/575* (2013.01); *G05F 1/468* (2013.01)

(58) Field of Classification Search
CPC ..... G05F 1/575; G05F 1/468
See application file for complete search history.

(56) References Cited

U.S. PATENT DOCUMENTS

| | | | | |
|---|---|---|---|---|
| 5,291,149 | A * | 3/1994 | Nunoshima | 330/255 |
| 5,399,991 | A * | 3/1995 | Moraveji | 330/255 |
| 5,515,005 | A * | 5/1996 | Yoshioka | 330/255 |
| 2011/0025655 | A1* | 2/2011 | Nishimura et al. | 345/204 |
| 2012/0092070 | A1* | 4/2012 | Fukushima | 330/255 |

OTHER PUBLICATIONS

Linear Technology Corporation Product Datasheet, LT3080 Adjustable 1.1A Single Resistor Low Dropout Regulator, pp. 1-28, 2007, <http://www.linear.com/product/LT3080>.

* cited by examiner

*Primary Examiner* — Emily P Pham
(74) *Attorney, Agent, or Firm* — Patent Law Group LLP; Brian D. Ogonowsky

(57) ABSTRACT

A linear regulator integrated circuit may be formed having four external terminals including a voltage input (Vin) terminal, a voltage output (Vout) terminal, a Set terminal, and an operational amplifier (op amp) power terminal. A user connects an external resistor to the Set terminal for creating a reference voltage. An op amp controls a pass (or series transistor) to cause an output voltage at the Vout terminal to equal the reference voltage. The op amp has a first power supply terminal internally coupled to the Vin terminal and a second power supply terminal coupled to the op amp power terminal. The op amp power terminal allows a user to externally couple the op amp second power supply terminal to either the Vout pin (for high voltage applications), system ground (for medium voltage applications), or another voltage (to provide additional headroom in very low voltage applications).

28 Claims, 3 Drawing Sheets

LINEAR REGULATOR IC WITH VERSATILE GROUND PIN

CROSS-REFERENCE TO RELATED APPLICATIONS

This application claims priority to U.S. Provisional Application Ser. No. 61/813,789, filed Apr. 19, 2013, by Robert Dobkin et al., assigned to the present assignee and incorporated herein by reference.

FIELD OF THE INVENTION

This invention relates to linear voltage regulator integrated circuits and, in particular, to such an IC that provides a versatile operational amplifier ground pin connection.

BACKGROUND

FIG. 1 illustrates one representative prior art linear voltage regulator 10, which is an LT3080 low dropout (LDO) regulator manufactured by Linear Technology Corp. An LDO regulator is generally synonymous with a linear voltage regulator, and the term "low dropout" refers to the small minimum voltage differential that can occur between the input voltage terminal and the regulated output voltage terminal while still achieving regulation.

LDO regulators operate by varying the conductivity of a pass (or series) transistor, connected between the input terminal and output terminal, to achieve a predetermined output voltage. The output level of an operational amplifier (op amp), which is a type of differential amplifier, controls the conductivity of the pass transistor. Typically, the regulator's output voltage is fed back into one input terminal of the op amp, and the conductivity of the pass transistor is controlled to match the output voltage to a reference voltage applied to the other input of the op amp. The user selects the reference voltage. Alternatively, a divided output voltage is fed back and matched to a fixed reference voltage, where the user selects resistors for the divider to achieve the desired output voltage.

In FIG. 1, the power supply voltage may be applied to both the Vin pin 12 and the Vcontrol pin 14 of the IC package. The user connects an Rset resistor 15 between a Set pin 16 and system ground to set the output voltage Vout provided at the Vout pin 18. A fixed precision current source 20 supplies a fixed current through the Rset resistor 15 to generate a reference voltage Vref at the non-inverting input of the op amp 22. The output voltage Vout is applied to the inverting input of the op amp 22. The terms inverting and non-inverting simply refer to the two branches of the differential amplifier in the op amp 22, shown in FIG. 2. It is assumed that the op amp 22 includes a driver supplying the required current for driving the base of the pass transistor 24.

Using an internal current source 20 and Rset resistor 15 to set the reference voltage is preferred to dividing the output voltage and matching the divided voltage to a fixed bandgap reference voltage source (typically about 1.2 volts), since, by using the current source, the loop gain and bandwidth of the regulator are not affected by the output voltage, as the regulator will always be in a unity gain configuration.

The op amp 22 controls the conductivity of the pass transistor 24 so that Vout matches Vref. Such an op amp in a regulator application is also referred to as an error amplifier.

In one application of the regulator 10, the op amp 22 has its power terminals connected to the Vout pin 18 and to the power supply voltage Vin, by externally shorting the Vcontrol pin 14 to the Vin pin 12. This allows the regulator to be "floating" and used in high voltage applications.

In a typical example, the op amp 22 needs about 1.4 volts across its power terminals in order to operate properly. Accordingly, when the Vcontrol pin 14 is tied to the Vin pin 12, the LDO regulator 10 (a positive voltage regulator) can only regulate Vout to within 1.4 volts of Vin in order for the op amp 22 to be adequately powered. It would be desirable for various reasons, including efficiency and battery life, to enable regulation within 1.4 volts of Vin. Accordingly, for non-high voltage applications, the data sheet for the LT3080 (FIG. 1) describes the option of connecting the Vcontrol pin 14 to a voltage higher than Vin so that the differential between Vin and Vout can go down to the Vce saturation voltage of the pass transistor 24 (typically 100-500 mV, depending on the load current), while still providing at least 1.4 volts to power the op amp 22. However, most applications do not already have a separate voltage source higher than Vin.

The LT3080 does not allow any power terminal of the op amp 22 to be tied to system ground. Being able to ground the op amp 22 provides various advantages, including low dropout voltage and independence from Vout.

Other types of voltage reference-based regulators always require the ground pin to be tied to the system ground, so there is no versatility in the ground pin coupling.

What is needed is an LDO regulator IC that has more versatility in the connection of its ground pin. This would allow the regulator's ground pin to be connected in a way that is most optimal for the particular application, such as low input voltage, high input voltage, low output voltage, regulation close to Vin, regulation close to ground, etc. Further, the concept should be applicable to both positive voltage regulators and negative voltage regulators.

SUMMARY

In one embodiment, a positive voltage LDO regulator IC uses an on-chip current source which, along with a user-selected Rset resistor connected between a Set pin and system ground, sets the reference voltage for the op amp. The op amp controls a driver for driving a pass transistor connected between the input voltage (Vin) pin and the output voltage (Vout) pin.

The reference voltage is tied to the inverting input of the op amp, and the non-inverting input of the op amp is tied to the Vout pin. The regulator controls the pass transistor to cause Vout to be substantially equal to the reference voltage.

A positive supply input terminal of the op amp is tied, on-chip, to the Vin pin and to the positive terminal of the current source. The Vin pin will usually be tied to the positive rail voltage, resulting in the current source and op amp to be tied to the maximum positive voltage.

The negative supply input terminal of the op amp is connected to its own IC pin. This allows the negative supply input terminal of the op amp to be connected to either system ground, Vout (a positive voltage), or a negative voltage. Each of the connections provides a different advantage, and the optimal connection will be based on the particular application. Thus, the product's increased flexibility allows it to be used in a wider variety of applications, resulting in increased sales.

The invention is equally applicable to a negative LDO regulator, where the positive supply input terminal of the op amp is connected to its own IC pin, allowing it to be externally connected to either system ground, Vout (a negative voltage), or a positive voltage.

The op amp used is a rail-to-rail type that can operate to control the pass transistor even when the output voltage (or set voltage) is close to either the upper rail voltage or the lower rail voltage.

The flexibility of the connections also allows the product to be interconnected with another LDO regulator to form a four quadrant power supply that can either source current to a load or sink current from the load. Such a power supply finds use in AC systems, Class AB amplifiers, and other applications.

In another embodiment, the op amp with the flexible supply input terminal can be an error amplifier in a switching voltage regulator.

Various other embodiments are described.

BRIEF DESCRIPTION OF THE DRAWINGS

Elements that are the same or equivalent are labeled with the same numeral.

DETAILED DESCRIPTION

A rail-to-rail op amp is used in one embodiment of a linear regulator to drive a pass transistor to regulate Vout anywhere within substantially the full range between the upper and lower voltage rails of the system.

Figure 1:
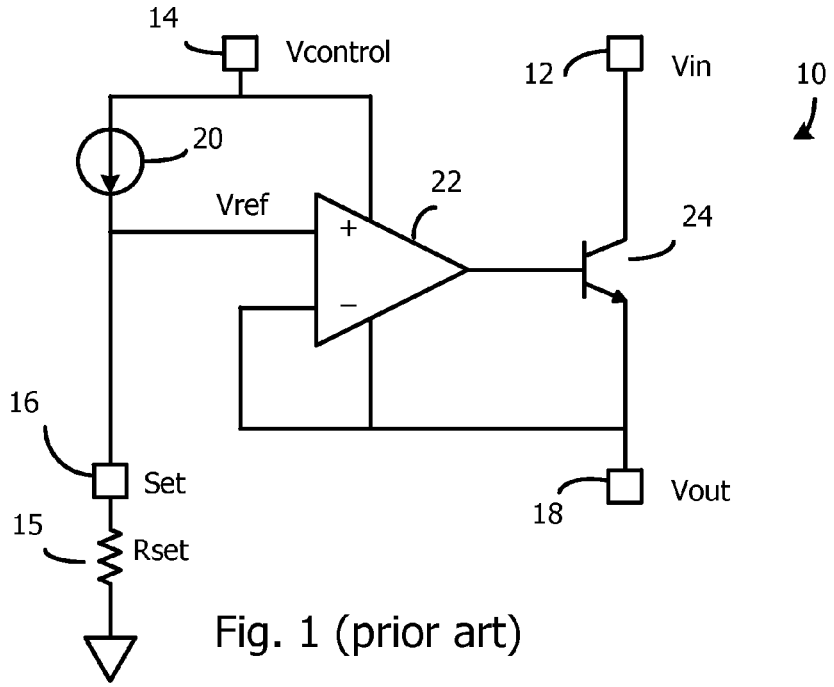
Fig. 1 (prior art)
FIG. 1 illustrates a prior art LT3080 positive voltage LDO regulator.
Figure 2:
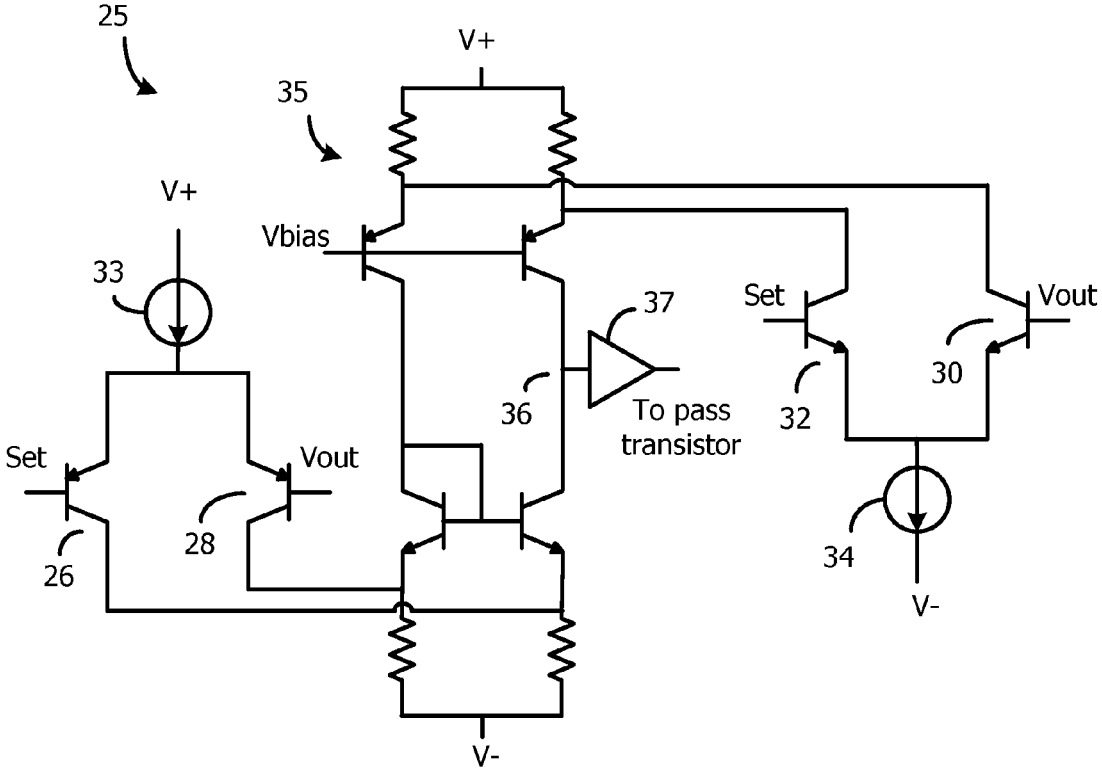
FIG. 2 illustrates a rail-to-rail op amp that may be used in a linear regulator in accordance with one embodiment of the present invention.

FIG. 2 is an example of a suitable rail-to-rail op amp 25, although many other configurations of rail-to-rail op amps can be used in the regulator. On the left side of the op amp 25 circuit, the Set voltage from the Set pin of the regulator is applied to the base of the PNP transistor 26, and the regulator's output voltage Vout is applied to the base of the PNP transistor 28. On the right side of the op amp 25 circuit, the output voltage Vout is applied to the base of the NPN transistor 30, and the Set voltage is applied to the base of the NPN transistor 32.

A current source 33 sources a fixed current to the tied emitters of the PNP transistors 26/28, and a current source 34 sinks a fixed current from the tied emitters of the NPN transistors 30/32. The op amp's power supply terminals (labeled V+ and V−) are tied between any two voltages, depending on the application. As more fully explained with respect to FIGS. 3-5, these two voltages may be the positive and negative rail voltages, positive and ground rail voltages, a positive rail voltage and Vout, ground and negative rail voltages, or Vout and a negative rail voltage.

Figure 4:
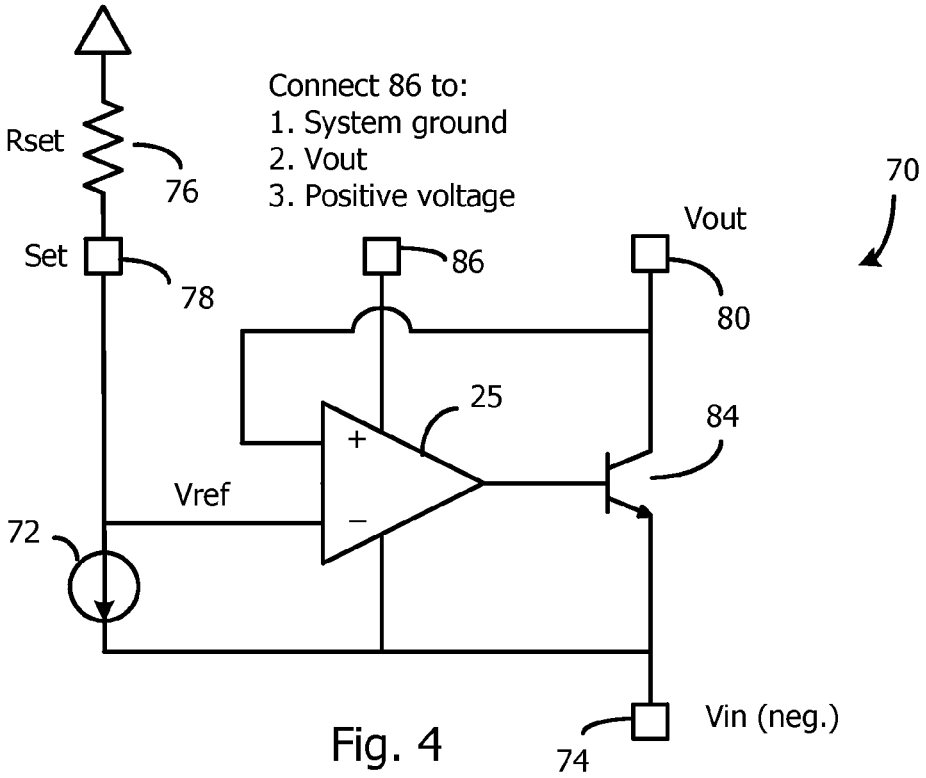
FIG. 4 illustrates a negative voltage LDO regulator IC in accordance with one embodiment of the present invention.

The Set and Vout inputs to the op amp 25 are configured for driving an NPN pass transistor, such as for the negative voltage regulator of FIG. 4. The op amp 25 inputs will be opposite for a linear regulator using a PNP pass transistor. Many other configurations of the op amp are suitable.

A summing circuit 35 receives the output signals from both sides of the op amp 25 circuit and generates a signal at node 36 for application to a conventional driver 37 (a buffer), where the driver 37 provides the necessary current to drive the base of the pass transistor. The signal at node 36 may be substantially anywhere between the upper and lower voltages applied to the V+ and V− terminals of the op amp 25. The pass transistor is connected across the Vin and Vout pins of the regulator IC. If the Vout/Set voltage is close to V+, then the differential amplifier on the right side of the circuit controls the drive signal for the pass transistor. For all other Vout/Set voltages, the differential amplifier on the left side of the circuit controls the drive signal.

The present invention applies to regulators using a wide variety of op amp configurations.

Op amps, such as the op amp 25, require a minimum voltage across its power terminals V+ and V− in order for them to operate. For example, the op amp 25 may require at least 1.4 volts between V+ and V−.

Figure 3:
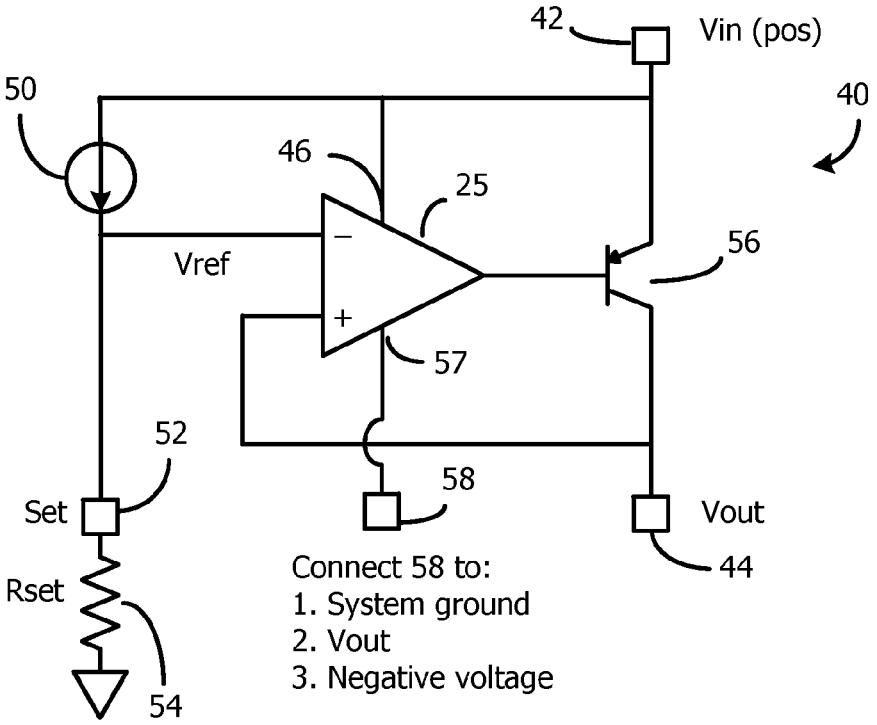
FIG. 3 illustrates a positive voltage LDO regulator IC in accordance with one embodiment of the present invention.
Figure 5:
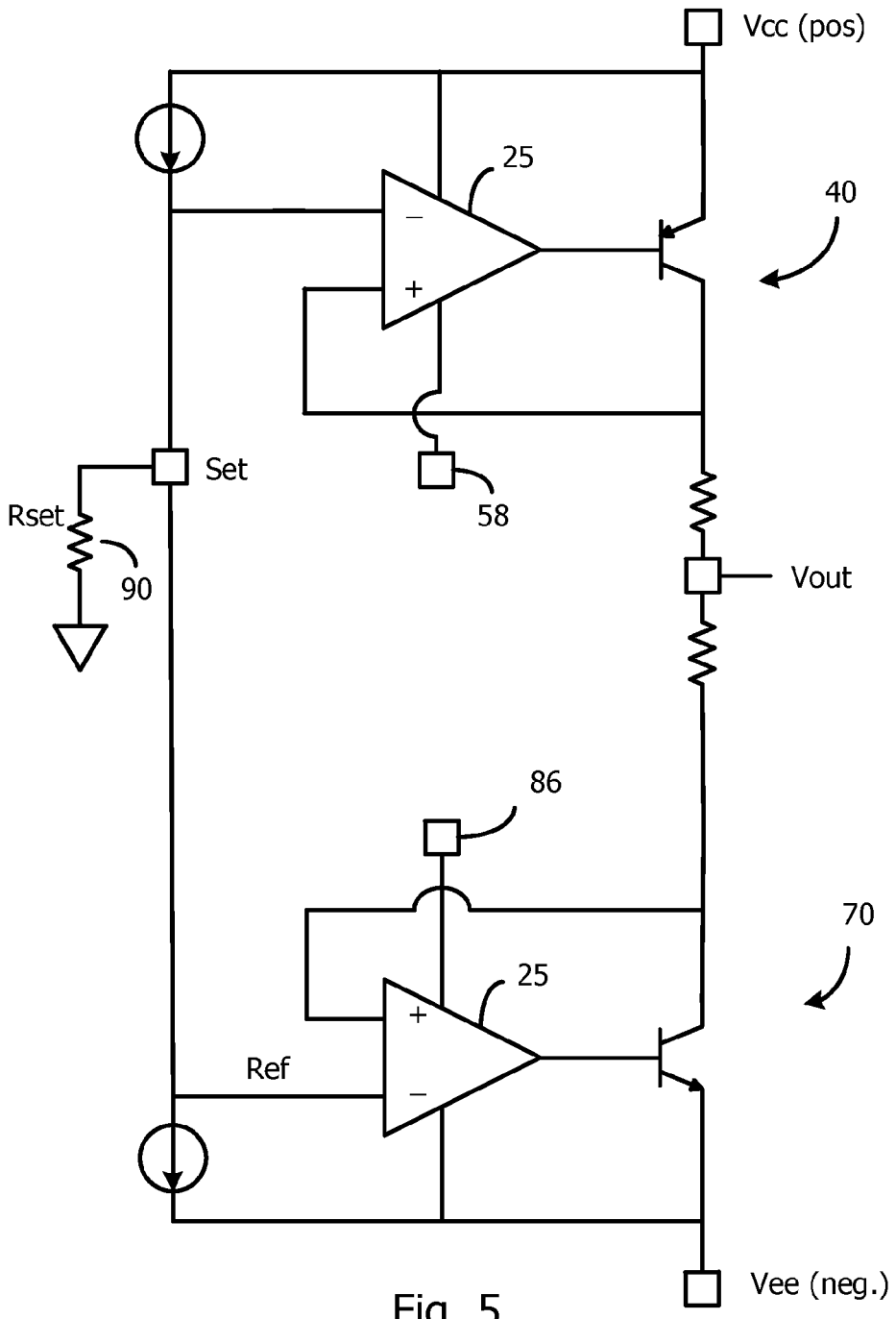
FIG. 5 illustrates a four quadrant power supply chip or system using the positive voltage LDO regulator of FIG. 3 in conjunction with the negative voltage LDO regulator of FIG. 4.

FIG. 3 illustrates the invention incorporated in a positive voltage LDO regulator 40, where the Vin pin 42 is connected to a positive power supply voltage Vin, and the Vout pin 44 is settable to provide virtually any voltage between approximately 300 mV below Vin and ground. In FIGS. 3-5, it is assumed that the op amp includes a driver circuit supplying the necessary current for driving the pass transistor.

The positive supply input terminal 46 of the op amp 25 is tied, on-chip, to the Vin pin 42 and the positive voltage input of the precision current source 50. In one embodiment, the current source 50 generates 50 microamps. The op amp 25 may be any type of op amp, such as shown in FIG. 2 or other types.

The inverting input of the op amp 25 is tied, on-chip, to the Set pin 52, and the non-inverting input of the op amp 25 is tied, on-chip, to the Vout pin 44. Tying terminals together on-chip, when possible, is important to reduce pin count and to make the chip easier to use.

The user connects an off-chip Rset resistor 54 between the Set pin 52 and ground to create a desired reference voltage Vref applied to the inverting input of the op amp 25. Generating the reference voltage using an on-chip current source 50 and an Rset resistor 54 is preferable over comparing a divided output voltage to a fixed bandgap reference, since operating characteristics of the feedback loop are not affected by the output voltage.

All components other than the Rset resistor 54 are on a single chip, which may be packaged in a 4-pin package.

A PNP pass (or series) bipolar transistor 56 is connected, on chip, between the Vin pin 42 and the Vout pin 44. The transistor 56 is controlled by the op amp 25 and feedback loop to cause Vout to be substantially equal to Vref.

The negative supply input terminal 57 of the op amp 25 is connected to its own pin 58 of the chip. Users of the circuit and the data sheet for the product may refer to the versatile pin 58 as a versatile "ground pin," even though the pin 58 may be connected to voltages other than ground, since a "ground pin" is a familiar term to users and is substituted by the versatile pin 58. Accordingly, the chip may use an inexpensive and small four pin package.

In applications where the regulator is operating at high voltages, such as 120 volts or higher, the pin 58 may be externally tied by the user to the Vout pin 44, so the regulator is floating. Hence, the op amp 25 only has to withstand the voltage differential Vin-Vout. A disadvantage of this connection is that the voltage differential cannot go below about 1.4 volts in order for the op amp 25 to operate properly.

At low operating voltages, the user can tie the pin 58 to the system ground. In this case, Vout can be closer to Vin without affecting the operation of the op amp 25, and the only drawback is that Vin must be above 1.4 volts in order for the op amp 25 to operate properly.

In some applications, a Vout of 1.2 volts and lower is used and, if a battery generates Vin, it would be beneficial to allow Vin to go below 1.4 volts to prolong useful battery life.

In a third option, the user may tie the pin 58 to a voltage more negative than Vout, such as generated by another power supply or a charge pump. In one example, the pin 58 is coupled to a negative voltage relative to ground. If such is the case, the power supply voltage for the op amp 25 will always be sufficient, independent of Vout or Vin, so the only limit for regulation is the Vce saturation voltage of the transistor 56, which may be as low as 100 mV for a low load current. Very little current is used by the op amp 25, so a low power source may be used to supply the negative voltage. In some applications, the system uses a variety of voltages, and a suitable voltage source may be already available.

Accordingly, the regulator 40 has greater flexibility than prior art regulators and can potentially operate more efficiently, depending on the application and how the user connects the pin 58.

FIG. 4 illustrates the concept being applied to a negative voltage LDO regulator 70. All components may be the same as in FIG. 3, but their configurations are different. In FIG. 4, Vin is more negative than Vout, such as a negative voltage with respect to ground. The current source 72 negative terminal is tied to the Vin pin 74 and sinks a fixed current (e.g., 50 microamps) through the Rset resistor 76, connected between the Set pin 78 and ground, to create the reference voltage Vref. The Vout pin 80 is tied to the non-inverting input terminal of the op amp 25. The op amp 25 controls the NPN transistor 84 to cause Vout to substantially equal Vref.

The negative supply input terminal of the op amp 25 is tied to the Vin pin 74, and the positive supply input terminal is connected to its own pin 86.

In applications where the regulator is operating at high negative voltages, such as −120 volts or higher, the pin 86 may be externally tied by the user to the Vout pin 80, so the regulator is floating. Hence, the op amp 25 only has to withstand the voltage differential Vin-Vout. A disadvantage of this connection is that the voltage differential cannot go below about 1.4 volts in order for the op amp 25 to operate properly.

At low operating voltages, the user can tie the pin 86 to the system ground. In this case, Vout can be closer to Vin without affecting the operation of the op amp 25, and the only drawback is that Vin must be more negative than −1.4 volts in order for the op amp 25 to operate properly.

In a third option, the user may tie the pin 86 to a voltage more positive than Vout, such as generated by another power supply or a charge pump. In one example, the pin 58 is coupled to a positive voltage relative to ground. If such is the case, the power supply voltage for the op amp 25 will always be sufficient, independent of Vout or Vin, so the only limit is the Vce saturation voltage of the transistor 84, which may be as low as 100 mV for a low load current. Very little current is used by the op amp 25, so a low power source may be used to supply the positive voltage. In some applications, the system uses a variety of voltages, and a suitable voltage source may be already available.

With the regulators of FIGS. 3 and 4, a load may be connected between the Vout pin and ground, and the regulator provides the regulated Vout for a wide range of load currents. Accordingly, the negative LDO voltage regulator 70 of FIG. 4 sinks current through the load, and the positive LDO regulator 40 of FIG. 3 sources current through the load.

The positive and negative LDO regulators utilizing the present invention can be connected to create a four quadrant power supply, as shown in FIG. 5, that can either sink current or source current to a load connected between the Vout pin and ground. The input voltages may be a positive Vcc voltage and a negative Vee voltage.

FIG. 5 illustrates how the regulators 40 and 70 may be interconnected, such as on a printed circuit board or within a single package, to generate either a positive voltage Vout or a negative voltage Vout, depending on the application. Also, depending on the application, the user can connect any of the op amp supply voltages described above to the pins 58 and 86. In one embodiment, the load requirements are variable, and the Rset resistor 90 can be automatically switched to a different resistance (such as by adding resistors in parallel or using a MOSFET) and different supply voltages are connected to the pins 58 and 86, depending on the optimal requirements for the application.

Many other uses of the inventive LDO voltage regulators are envisioned.

In other embodiments, the amplifiers do not need to be op amps and do not need to be differential. Further, the invention may be used in non-regulator circuits, such as a circuit that provides a reference voltage.

While particular embodiments of the present invention have been shown and described, it will be obvious to those skilled in the art that changes and modifications may be made without departing from this invention in its broader aspects and, therefore, the appended claims are to encompass within their scope all such changes and modifications that are within the true spirit and scope of this invention.

What is claimed is:

1. A voltage regulator comprising:

a current source having a first terminal coupled to a reference voltage terminal and a second terminal coupled to a voltage input (Vin) terminal, the reference voltage terminal for being connected to a component for creating a reference voltage;

an amplifier having a first input terminal coupled to receive the reference voltage, the amplifier having a second input terminal coupled to an output voltage (Vout) terminal for receiving an output voltage of the regulator;

the amplifier having a first power supply terminal coupled to the Vin terminal;

the amplifier having a second power supply terminal; and an output circuit controlled by an output of the amplifier for causing an output voltage at the Vout terminal to substantially equal the reference voltage, the second power supply terminal being configured to allow a user to couple the second power supply terminal to either the Vout terminal, system ground, or another voltage in order to provide a sufficient voltage across the first power supply terminal and the second power supply terminal during operation to allow the amplifier to operate properly to achieve output voltage regulation.

2. The regulator of claim 1 wherein the amplifier is an operational amplifier, and the output circuit comprises a pass transistor controlled by an output of the operational amplifier.

3. The regulator of claim 1 wherein the regulator is formed as a packaged integrated circuit (IC) having external terminals comprising the Vin terminal, the Vout terminal, the reference voltage terminal, and the second power supply terminal.

4. The regulator of claim 3 wherein the first power supply terminal is coupled to the Vin terminal inside the package.

5. The regulator of claim 3 wherein a reference voltage set resistor is connected to the reference voltage terminal external to the package.

6. The regulator of claim 3 wherein the first power supply terminal is coupled to the Vin terminal inside the package.

7. The regulator of claim 3 wherein the regulator is a negative voltage regulator, where the Vin terminal is connected to a voltage that is more negative than the output voltage, and wherein the second power supply terminal is externally connectable to any one of the Vout terminal, system ground, and a positive voltage.

8. The regulator of claim 7 wherein the second power supply terminal is externally connected to the Vout terminal.

9. The regulator of claim 7 wherein the second power supply terminal is externally connected to system ground.

10. The regulator of claim 7 wherein the second power supply terminal is externally connected to the positive voltage.

11. The regulator of claim 3 wherein the regulator is a positive voltage regulator, where the Vin terminal is connected to a voltage that is more positive than the output voltage, and wherein the second power supply terminal is externally connectable to any one of the Vout terminal, system ground, and a negative voltage.

12. The regulator of claim 11 wherein the second power supply terminal is externally connected to the Vout terminal.

13. The regulator of claim 11 wherein the second power supply terminal is externally connected to system ground.

14. The regulator of claim 11 wherein the second power supply terminal is externally connected to a negative voltage.

15. The regulator of claim 1 wherein the amplifier is a rail-to-rail amplifier generating a drive signal to control a pass transistor, wherein the drive signal has a range substantially between the voltages supplied to the first power supply terminal and the second power supply terminal of the amplifier.

16. The regulator of claim 15 wherein the amplifier comprises two differential amplifiers having inputs coupled to the first input terminal and the second input terminal.

17. The regulator of claim 1 wherein the amplifier controls an NPN pass transistor connected between the second terminal and the Vout terminal.

18. The regulator of claim 1 wherein the amplifier controls a PNP pass transistor connected between the second terminal and the Vout terminal.

19. A method of using a regulator circuit, the regulator circuit comprising a voltage input (Vin) terminal, a voltage output (Vout) terminal, a reference voltage terminal, an amplifier first power supply terminal coupled to the Vin terminal, and an amplifier second power supply terminal, the regulator further comprising a current source having a first terminal coupled to the reference voltage terminal and a second terminal coupled to the Vin terminal, the method comprising:

connecting the reference voltage terminal to an external resistance for creating a reference voltage;

coupling the second power supply terminal to any of the Vout terminal, system ground, or another voltage, in order to provide a sufficient voltage across the first power supply terminal and the second power supply terminal during operation to allow the amplifier to operate properly to achieve output voltage regulation;

applying the reference voltage to a first input of the amplifier;

applying a voltage corresponding to the output voltage to a second input of the amplifier; and controlling an output circuit by an output of the amplifier to regulate an output voltage of the regulator to substantially match the voltages at the first input of the amplifier and the second input of the amplifier.

20. The method of claim 19 wherein the regulator is formed as a packaged integrated circuit (IC) having external terminals comprising the Vin terminal, the Vout terminal, the reference voltage terminal, and the second power supply terminal.

21. The method of claim 19 wherein the regulator is a negative voltage regulator, where the Vin terminal is connected to a voltage that is more negative than the output voltage, and wherein the step of coupling the second power supply terminal comprises connecting the second power terminal to one of the Vout terminal, system ground, and a positive voltage.

22. The method of claim 21 further comprising connecting the second power supply terminal to the Vout terminal.

23. The method of claim 21 further comprising connecting the second power supply terminal to system ground.

24. The method of claim 21 further comprising connecting the second power supply terminal to the positive voltage.

25. The method of claim 19 wherein the regulator is a positive voltage regulator, where the Vin terminal is connected to a voltage that is more positive than the output voltage, and wherein the step of coupling the second power supply terminal comprises connecting the second power supply terminal to one of the Vout terminal, system ground, and a negative voltage.

26. The method of claim 25 further comprising connecting the second power supply terminal to the Vout terminal.

27. The method of claim 25 further comprising connecting the second power supply terminal to system ground.

28. The method of claim 25 further comprising connecting second power supply terminal to the negative voltage.

* * * * *